US005180291A

United States Patent [19]

Kent

[11] Patent Number: 5,180,291

[45] Date of Patent: Jan. 19, 1993

[54] PULSATING OIL INJECTOR FOR RADIAL REFRIGERANT COMPRESSOR

[75] Inventor: Scott E. Kent, Albion, N.Y.

[73] Assignee: General Motors Corporation, Detroit, Mich.

[21] Appl. No.: 874,317

[22] Filed: Apr. 27, 1992

[51] Int. Cl.[5] ..... F04B 27/04; F04B 39/02

[52] U.S. Cl. ..... 417/273; 184/6.3; 184/6.6; 92/154; 92/156; 417/299

[58] Field of Search ..... 184/6.3, 6.6; 92/74, 92/153, 154, 156; 417/299, 273

[56] References Cited

U.S. PATENT DOCUMENTS

| | | | |
|---|---|---|---|
| 2,193,244 | 3/1940 | Wolcott | 417/299 |
| 3,348,764 | 10/1967 | Romerhaus | 417/299 X |
| 3,522,999 | 8/1970 | Liles | 417/282 |
| 3,784,331 | 1/1974 | Heidorn | 417/273 |
| 3,910,164 | 10/1975 | Swadner et al. | 92/128 |
| 4,392,788 | 7/1983 | Nakamura et al. | 417/269 |
| 4,441,863 | 4/1984 | Hotts et al. | 417/281 |
| 4,746,275 | 5/1988 | Iwamori et al. | 417/269 |
| 4,922,715 | 5/1990 | Furumoto et al. | 60/329 |

FOREIGN PATENT DOCUMENTS

| | | | |
|---|---|---|---|
| 175798 | 9/1985 | Japan | 417/299 |

*Primary Examiner*—Leonard E. Smith
*Attorney, Agent, or Firm*—Ronald L. Phillips

[57] ABSTRACT

A radial refrigerant compressor assembly for use in automotive refrigerant systems and capable of being cycled between on and off conditions having a fluid passageway extending between the bottom portion of the discharge chamber which operates at discharge pressure and the suction chamber which operates at a reduced suction pressure. A valve is disposed within the fluid passageway and regulates the flow of lubricant between the discharge and suction chambers under the force of the pressure differential existing between these chambers just after the compressor is cycled on and just after the compressor is cycled off.

1 Claim, 2 Drawing Sheets

PULSATING OIL INJECTOR FOR RADIAL REFRIGERANT COMPRESSOR

BACKGROUND OF THE INVENTION (1) Technical Field

The subject invention is directed toward a radial refrigerant compressor assembly for use in automotive refrigerant systems having a fluid passageway extending between the discharge chamber which operates at an elevated pressure and the suction chamber which operates at a reduced suction pressure with a valve member disposed in the passageway to control the flow of lubricant from the discharge chamber to the working elements located in the housing in the common suction chamber when the compressor assembly is cycled on and off.

(2) Description of the Prior Art

Radial compressors have long been used for the purpose of compressing a recirculated refrigerant in an automotive air conditioning application. Compressors of this type generally include substantially cylindrically shaped housings having an offset crank drive shaft centrally supported within the housing and powered from an electromagnetically clutched continuously driven pulley. The pulley, in turn, is coupled to the power take off of an automotive engine via a flexible endless driving belt as is commonly known in the art.

Radial compressors further include a plurality of pistons radially disposed within the housing and about the shaft and which reciprocate within corresponding cylinders so as to form compression chambers. A single radially disposed discharge chamber is associated with the piston cylinder arrangements for receiving the compressed refrigerant and directing it toward the compressor exhaust port. Typically, in compressors of this type, the drive shaft, counterweight, associated bearings and other working elements of the compressor are supported in the housing in the space that also serves as a suction chamber and which operates at suction pressure. Lubricant is circulated through this chamber to lubricate the working elements in the form of a fine oil mist which is entrained in the refrigerant gas. The lubricant will then adhere to and collect on the various working elements eventually drip down past the piston/cylinder arrangements and collect or pool in the discharge chamber. More specifically, and in radial compressors of this type, the lubricant tends to pool in the lowermost portion of the radial discharge chamber directly associated with the piston which is most vertically disposed within the housing and which reciprocates to the lowest point relative to the housing. In other words, the lubricant in radial compressors tends to collect in the lowest portion of the discharge chamber relative to the rest of the housing.

The lubrication of mechanical working parts housed within a radial compressor has always been a concern for design engineers. Excessive wear and heat generated by the working parts of this type of compressor can quickly erode optimum working parameters such as volumetric efficiency and can ultimately lead to seizure or other types of failure in the compressor. It is therefore important that the lubricant is adequately distributed throughout the assembly. Further, because radial compressors are especially dependent upon adequate lubrication, it is very important that oil be distributed immediately at start up of the compressor or very shortly thereafter. It is therefore desirable that a radial refrigerant compressor assembly include a mechanism which provides for the injection of lubricant directly into the working elements of the compressor just as the compressor is cycled off, or shortly thereafter, and just as the compressor is cycled on, or shortly thereafter. In this way, adequate lubrication of the working elements of the compressor can be maintained during critical operating periods.

SUMMARY OF THE INVENTION AND ADVANTAGES

The subject invention overcomes the deficiencies in the prior art in a radial refrigerant compressor assembly for use in automotive refrigerant systems which includes a fluid passageway extending between the lowest portion of the annular discharge chamber and the suction chamber and which includes a valve member disposed in the passageway and which is responsive to the pressure differential existing between the suction and discharge chambers to control the flow of lubricant from the discharge chamber to the working elements housed in the central suction chamber in the housing when the compressor assembly is cycled on and off.

More specifically, the subject invention is directed toward a radial refrigerant compressor including a housing which defines a suction chamber operating at a first lower predetermined pressure and a discharge chamber operating at a second higher predetermined pressure. The housing is adapted to be mounted to a support structure and a rotatable drive shaft is centrally supported within the housing. A plurality of pistons are radially disposed in the housing about the centrally supported shaft and are adapted to reciprocate in cylinders so as to form compression chambers such that at least one piston reciprocates in a substantially vertical direction.

The discharge chamber includes a bottom portion and is in fluid communication with the compression chamber formed by the piston reciprocating in its respective cylinder so as to receive fluid exiting the compression chamber at its second higher discharge pressure. The bottom portion of the discharge chamber is also particularly adapted to receive lubricant which drips down from the working elements of the compressor and collects in the bottom portion of the discharge chamber. A fluid passageway extends between the bottom portion of the discharge chamber and the suction chamber. A valve means is disposed within the fluid passageway. The valve means includes a valve body and a valve member movable between first and second positions within the valve body to open or close the fluid passageway.

A biasing means is disposed within the valve body and biases the valve member to its first open position with a predetermined force to open the fluid passageway. The valve member is also responsive to a predetermined discharge pressure generated in the discharge chamber to overcome the biasing force of the biasing means so as to move the valve member to the second closed position to close the passageway. In this way, lubricant that has collected in the bottom portion of the discharge chamber is injected into the suction chamber through the fluid passageway and past the valve member by the force created by the pressure differential existing between the discharge chamber and the suction chamber when the radial compressor assembly is cycled from the off condition to the on condition and when the radial compressor assembly is cycled from the on condition to the off condition and while the biasing force of the biasing means is able to overcome the discharge pressure acting on the valve member to move the valve member to its first open position, thereby distributing lubricant throughout the housing.

In this way, the subject invention overcomes the problems associated in the prior art by providing better lubrication of the working elements of radial compressors during critical periods when wear and tear on such elements are greatest.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE BEST MODE OF CARRYING OUT THE INVENTION

Figure 1:
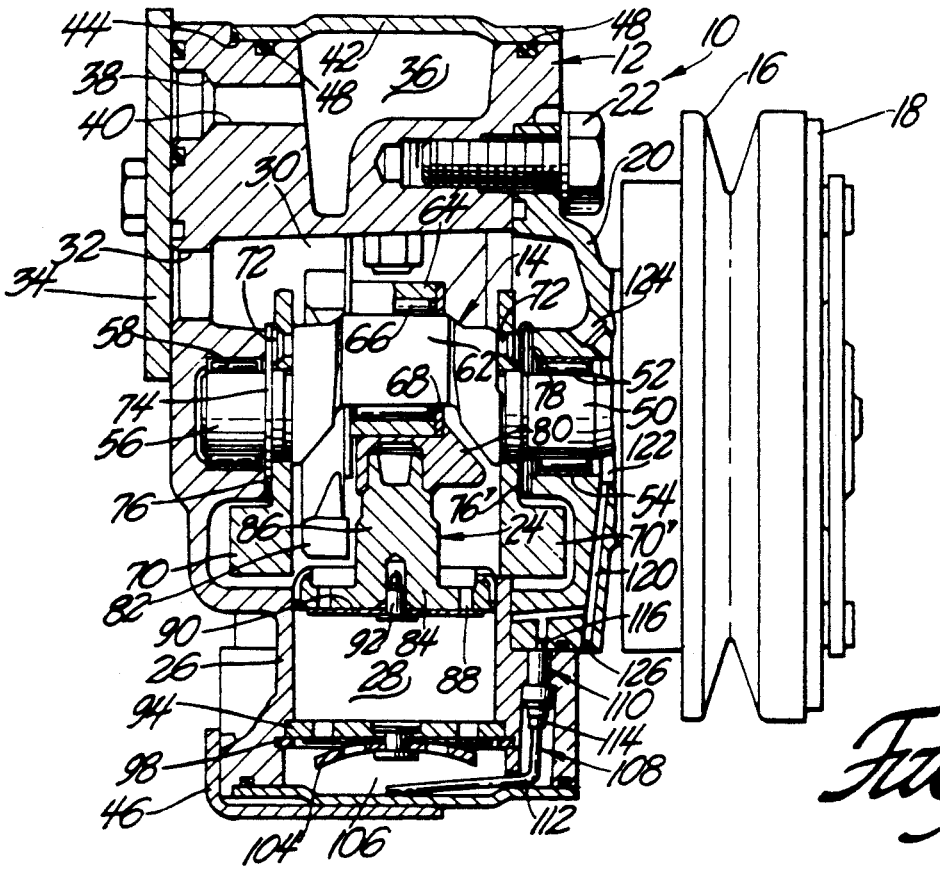
FIG. 1 is a partial cross-sectional side view of a radial refrigerant compressor assembly employing a fluid passageway extending between the discharge and suction chambers and having a valve member disposed therebetween.

A radial refrigerant compressor assembly for use in automotive refrigerant systems and capable of being cycled between on and off conditions is generally shown at 10 in FIG. 1. Refrigerant compressor assemblies of this type are employed in automotive air conditioning systems having the normal condenser for condensing a refrigerant gas into a liquid, an orifice tube, an evaporator, and an accumulator arranged in that order, (but not shown) between the compressor discharge and suction sides as is commonly known in the art. The assembly 10 includes a cylindrical housing 12 which is adapted to be mounted to a support structure (not shown) so as to be orientated substantially as shown in FIG. 1. A drive shaft 14 is rotatably and centrally supported within the housing 12 and is driven by a continuously driven pulley 16 via an electromagnetic clutch 18. More specifically, the pulley 16 is coupled to the output of an automotive engine (not shown) by a flexible endless driving belt so as to be continuously driven while the compressor assembly 10 is cycled on and off as needed via the electromagnetically actuated clutch 18. The clutch 18 translates torque from the engine, through the pulley 16 to the drive shaft 14, as is commonly known in the art. The pulley 16 and clutch 18 are supported by a front head, generally indicated at 20, which, in turn, is fixedly mounted to the housing 12 via fasteners 22 or the like.

The compressor 10 also includes a plurality of pistons, generally indicated at 24, radially disposed within the housing 12 and about the centrally supported drive shaft 14 and which are adapted to reciprocate in cylinders 26 so as to form compression chambers 28. More specifically, and in the radial compressor 10 of the subject invention, there are four pistons 24 which are arranged in 90* radial increments relative to one another and about the drive shaft 14. Each piston 24 forms one half of a double ended piston assembly. The subject compressor 10 includes two identical double ended piston assemblies which are reciprocal along axes which are perpendicular to one another. However, only one of the pistons 24 is shown in detail in FIG. 1. Further, the compressor 10 of the subject invention may include any number of pistons 24 disposed radially about a centrally supported axis and is not limited to the number employed by the compressor 10 illustrated in the Figures. The piston 24 will be discussed in greater detail below.

Many of the working elements of the compressor 10 are disposed within a central area of the housing which forms a central suction chamber 30 which services each of the four compression chambers 28 formed by the piston and cylinders 24, 26. The suction chamber 30 operates at a first lower predetermined pressure and receives gaseous refrigerant through intake port 32. Note that while intake port 32 is shown sealed off by a protective shipping plate 34 in FIG. 1, in its operative mode, this would not be the case.

The housing 12 further defines a discharge chamber as indicated, for example, at 36 which operates at a second higher predetermined pressure relative to the suction pressure and which is adapted to receive compressed refrigerant which exits the compression chamber 28 under the influence of the reciprocating pistons 24. The discharge chamber 36 is disposed radially about the pistons 24 and will be discussed in greater detail below.

A discharge port 38 communicates with the radial discharge chamber 36 via passage 40 to deliver compressed refrigerant at high pressure to the condenser. As with the intake port 32, the discharge port 38 is also shown sealed off by the plate 34 in FIG. 1 and in its operative mode, this would not be the case.

A cylindrical band 42 which abuts a flange 44 on the outer periphery of the housing 12 is employed to enclose the discharge chamber 36. The band 42 may be held in place by any suitable fastening means such as the clip 46. Furthermore, annular seals 48 are employed at the periphery of the housing 12 on both sides of the discharge chamber 36 to perfect the seal between the band 42 and the housing 12.

The drive shaft 14 includes a front end portion 50 which is rotatably supported by bearings 52 in a front hub 54 of the head 20. The shaft 14 also includes a rear end portion 56 which is similarly rotatably supported by bearings 58 on the rear hub 60 formed in the housing 12 opposite hub 54 in head 20. The shaft 14 has an eccentric or offset portion 62 having a slider block 64 mounted thereon and adapted for relative rotation between the eccentric portion 62 of the shaft and the slider block 64 via a plurality of separate elongated bearings 66. The bearings 66 are retained against axial movement relative to the eccentric portion 62 by needle retainers 68.

Counter weights 70, 70' are pivotally mounted to the eccentric portion 62 by rivets 72. A thrust washer 74 is provided between the rear hub 60 and the outer surface 76 of the counter weight 70. Similarly, a front thrust washer 78 is provided between the front hub 54 and the outer surface 76' of the counter weight 70'. The assembly 10 further includes a pair of yokes 80, 82 which are integral with the pair of 180° opposed or double ended identical piston assemblies. As mentioned previously, only one of the pistons 24 which is integral with yoke 80 is shown in FIG. 1. The piston 24 includes a head 84 and a connecting portion 86 which extends between the head 84 and the yoke 80. The piston head 84 includes a plurality of radially disposed suction ports 88 which are controlled by flapper valves 90 mounted to the piston head 84 by a fastener 92 as is commonly known in the art. The double ended piston assemblies described and shown herein are similar to the piston assemblies found in the U.S. Pat. No. 3,784,331, issued Jan. 8, 1974 to Heidorn and U.S. Pat. No. 3,910,164 issued on Oct. 7, 1975 to Swadner et al, both of which are assigned to the assignee of the present invention. Accordingly, the disclosures of both of these patents are incorporated by reference herein.

Figure 2:
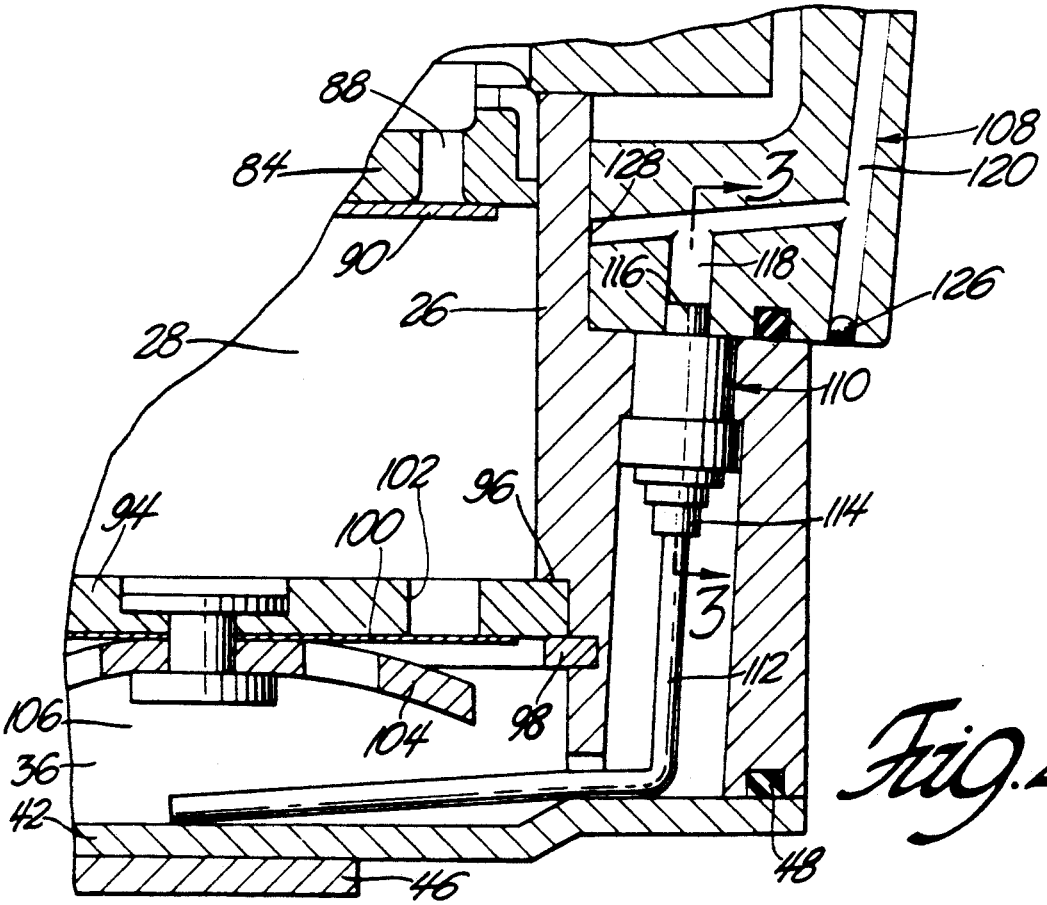
FIG. 2 is an enlarged cross-sectional side view showing a portion of the compressor assembly shown in FIG. 1 and illustrating the fluid passageway extending between the discharge and suction chambers with a valve member of the subject invention disposed therein.

With reference to FIG. 2, the compressor assembly 10 includes a valve plate 94 mounted against a flange 96 formed in the cylinder 26 and retained there by a snap ring 98. A discharge reed valve 100 controls the flow of compressed refrigerant through a series of circumferentially spaced discharge apertures 102 and into the discharge chamber 36. A discharge valve backstop 104 is also included to limit the travel of the discharge reed valve 100 during the exhaust of compressed refrigerant from the compression chamber 28 as is commonly known in the art.

As can be seen in FIG. 1, when the radial pressure assembly 10 is mounted in a conventional manner at least one piston 24 reciprocates in a substantially vertical direction. The discharge chamber 36 is in fluid communication with the compression chamber 28 formed by the piston 24 reciprocating in the cylinder 26 via discharge valve 100 as mentioned above. As such, the discharge chamber 36 receives fluid exiting the compression chamber 28 at a higher discharge pressure. Further, the radially disposed discharge chamber 36 includes a bottom portion 106 which occupies the lowest position within the housing 12. The bottom portion 106 of the discharge chamber 36 is therefore adapted to receive and collect lubricant which had previously been circulated in the housing 12 as a mist entrained in the refrigerant gas at suction pressure and which has dripped down into the discharge chamber 36 under the force of gravity. As alluded to above, this lubricant pooling phenomenon inherent in radial compressors is not desirable and exacerbates the dependency such compressors invariably have on adequate lubrication.

Furthermore, the pooling of lubricant in the bottom portion 106 of the discharge chamber 36 is at its worst when the compressor has sat dormant for as little as a few hours—such as overnight. Unfortunately, the next time the compressor is cycled on is also a time when the working elements need to adequately oiled as the greatest wear can occur then. Failure to effectively deal with lubricant pooling in the bottom portion of the discharge chamber by the prior art greatly contributed to the wear on the working elements of the compressor and shortened working life.

The subject invention overcomes this problem by including a fluid passageway, generally indicated at 108, extending between the bottom portion 106 of the discharge chamber 36 and the portion of the housing 12 which forms the suction chamber 30. As alluded to above, the suction chamber 30 operates at a first lower predetermined pressure relative to the second higher predetermined pressure of the discharge chamber 36. As such, a relatively large pressure differential exists between the two chambers when the compression assembly is operating at steady state conditions.

A valve means, generally indicated at 110, is positioned in the fluid passageway 108 to control the flow of fluid between the suction and discharge chambers 30, 36 respectively. More specifically, as best shown in FIG. 2, the fluid passageway 108 includes a lower "L" shaped portion 112 which provides fluid communication between the bottom portion 106 of the discharge chamber 36 and the inlet 114 of the valve means 110. A valve outlet 116 communicates with an exit passageway 118 which, in turn, communicates with an upper "L" shaped passage 120 extending through the head 20. The upper "L" shaped passageway 120 provides fluid communication with an annular passage 122 in the front hub 54 of the head 20 as shown in FIG. 1. The annular passage 122 is disposed about the drive shaft 14 and provides lubricant to the shaft 14 as well as the front hub bearings 52 and other working elements. In addition, a lubricant bleed passage 124 provides an outlet from the annular passage 122 into the suction chamber 30 of the housing 12. As can best be seen in FIG. 2, the substantially vertical portion of the upper "L" shaped passageway 120 terminates at its lower end at a small ball seal 126 which is press fit into the passage. Similarly, the substantially horizontal portion of the upper "L" shaped passageway 120 terminates at one end in abutting sealing contact with the outer surface 128 of the cylinder 26.

Figure 3:
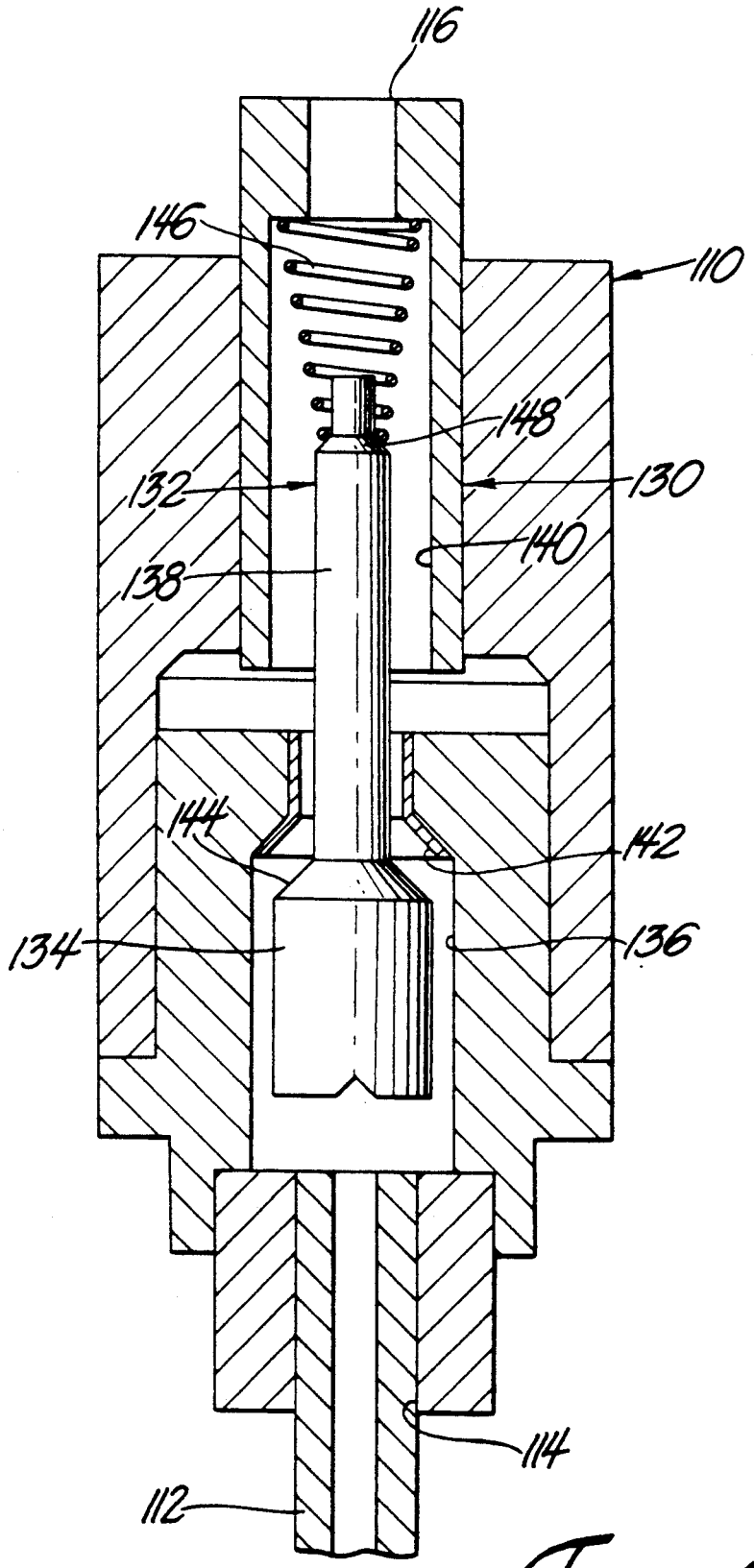
FIG. 3 is a cross-sectional side view of the valve member of the subject invention taken substantially along lines 3—3 of FIG. 2.

Referring to FIG. 3, the valve means 110 includes a valve body, generally indicated at 130, and a valve member, generally indicated at 132, which is movable between first and second positions within the valve body 130 to open or close the inlet 114 and outlet 116 of the valve means 110 to the fluid passageway 108. More specifically, the valve member 132 includes an enlarged head 134 which is movable within a first enlarged valve chamber 136 in the valve body 130 and which is exposed to the second higher predetermined discharge pressure. The valve member 132 also includes an elongated shaft member 138 of reduced diameter which is movable within a second valve chamber 140 in the valve body 130 and which is exposed to the first lower predetermined pressure extant in the suction chamber 30. The valve body 130 also includes a conical portion 142 which accommodates the conical portion 144 of the valve member 132 disposed between the head 134 and the shaft member 138.

A biasing means in the form of a coiled spring 146 is located within the second valve chamber 140 and acts between one end of the valve chamber 140 and a frustro-conical end portion 148 of the shaft member 138 to bias the valve member 132 to its first open position. More specifically, the valve member 132 is so designed that while the coiled spring 146 biases the valve member 132 to its open position with a predetermined force to open the fluid passageway 108, the valve member 132 is also responsive to the predetermined discharge pressure generated in the discharge chamber 36 to overcome the biasing force of the coiled spring 146 and move the valve member 132 to its second closed position to close the passageway 108.

The valve means 110 of the subject invention operates in the following manner. When the compressor assembly 10 is operating at steady state conditions, the discharge pressure generated by the pistons 24 reciprocating in the cylinders 26 acts on the enlarged head 134 of the valve means 132 via the lower "L" shaped portion 112 of the passageway 108 to overcome the biasing force of the coiled spring 146 and move the valve member 132 to its closed position. At this point, the pressure differential between the suction and discharge chambers is relatively large and there is no fluid communication between the suction and discharge chambers 30, 36 respectively.

When the compression compressor assembly 10 is cycled off, however, torque is no longer translated to the shaft 14 and the pressure differential between the suction and discharge chambers 30, 36 respectively decreases to a predetermined value. At this point, the biasing force of the coiled spring 146 overcomes the force of the discharge pressure acting on the head 134 of the valve member 132 thereby moving the valve member to its open position. At this point, lubricant which has collected at the bottom portion 106 of the discharge chamber 36 is injected into the fluid passageway 108, past the valve member 132 and into the annular passage 122 in the front hub 54 of the housing 20 and also through the lubricant bleed passage 124. Thus, working elements such as the shaft 14, front hub bearings 52 and other elements in the entire suction chamber 30 are squirted with lubricant just after the compressor 10 is cycled off using the remaining pressure differential existing between the suction and discharge chambers 30, 36 to distribute the lubricant.

Similarly, when the compressor 10 is later cycled back on, torque will again be translated from the pulley 16 to the shaft 14 to reciprocate the pistons 24 thereby creating a pressure differential between the suction and discharge chambers 30, 36, respectively. The valve means 110 will remain in its open position, however, until the pressure differential is so great that the discharge pressure acting on the enlarged head 134 of the valve member 132 overcomes the biasing force of the coiled spring 146 acting on the shaft member 138 to close the valve. Until that time, however, the pressure differential between the suction and discharge chambers will act to force lubricant which has collected in the bottom portion of the discharge chamber 36 to be injected through the fluid passageway 108, past the valve member 132 and into the suction chamber 30 to lubricate the working elements as described above.

In this way, the working elements of the radial compressor of the subject invention are lubricated after the compressor has been cycled off and just as the compressor is cycled on and thus during critical operating time periods when wear and tear on the compressor are greatest. This results in maintained efficiency and increased longevity of the radial compressor.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims the invention may be practiced otherwise than as specifically described.

What is claimed is:

1. A radial refrigerant compressor assembly for use in automotive refrigerant systems and capable of being cycled between on and off conditions, said assembly comprising;

a housing defining a suction chamber operating at a first lower predetermined pressure and a discharge chamber operating at a second higher predetermined pressure, said housing adapted to be mounted to a support structure, and a rotatable shaft centrally supported within said housing;

a plurality of pistons radially disposed in said housing about said centrally supported shaft and adapted to reciprocate in cylinders so as to form compression chambers such that at least one piston reciprocates in a substantially vertical direction;

said discharge chamber being in fluid communication with said compression chamber formed by said at least one piston reciprocating in its respective cylinder so as to receive fluid exiting said compression chamber at said second higher discharge pressure and also to receive lubricant which collects in said discharge chamber associated with said lowest substantially vertically reciprocating piston;

a fluid passageway extending between said discharge chamber and said suction chamber, a valve means disposed within said fluid passageway, said valve means including a valve body and a valve member movable between first and second positions within said valve body to open and close said passageway;

a biasing means disposed within said valve body and biasing said valve member to said first open position with a predetermined force to open said fluid passageway, said valve member also being responsive to a predetermined discharge pressure generated in said discharge chamber to overcome said biasing force of said biasing member and move said valve member to said second closed position to close the passageway such that lubricant which has collected in said discharge chamber is injected into said suction chamber through said fluid passageway and past said valve member by the force created by the pressure differential existing between said discharge chamber and said suction chamber when said radial compressor assembly is cycled from the off condition to the on condition and when said radial compressor assembly is cycled from the on condition to the off condition and while the biasing force of said biasing means is able to overcome the discharge pressure acting on said valve member to move said valve member to said first open position to distribute lubricant throughout the housing.

* * * * *